US009514683B2

(12) United States Patent
Cao et al.

(10) Patent No.: US 9,514,683 B2
(45) Date of Patent: Dec. 6, 2016

(54) GATE DRIVING CIRCUIT, GATE DRIVING METHOD, GATE ON ARRAY (GOA) CIRCUIT AND DISPLAY DEVICE

(71) Applicant: BOE TECHNOLOGY GROUP CO., LTD., Beijing (CN)

(72) Inventors: Kun Cao, Beijing (CN); Zhongyuan Wu, Beijing (CN); Liye Duan, Beijing (CN)

(73) Assignee: BOE TECHNOLOGY GROUP CO., LTD. (CN)

( * ) Notice: Subject to any disclaimer, the term of this patent is extended or adjusted under 35 U.S.C. 154(b) by 13 days.

(21) Appl. No.: 14/415,082

(22) PCT Filed: May 29, 2014

(86) PCT No.: PCT/CN2014/078725

§ 371 (c)(1),
(2) Date: Jan. 15, 2015

(87) PCT Pub. No.: WO2015/096387

PCT Pub. Date: Jul. 2, 2015

(65) Prior Publication Data

US 2016/0019840 A1 Jan. 21, 2016

(30) Foreign Application Priority Data

Dec. 26, 2013 (CN) ..... 2013 1 0738811

(51) Int. Cl.
*G09G 3/32* (2016.01)

(52) U.S. Cl.
CPC ..... *G09G 3/3266* (2013.01); *G09G 3/3225* (2013.01); *G09G 2300/0871* (2013.01); *G09G 2320/0233* (2013.01); *G09G 2320/045* (2013.01)

(58) Field of Classification Search
CPC ..... G09G 3/3266; G09G 3/3225; G09G 2320/0233; G09G 2320/045; G09G 2300/0871; G09G 3/32
(Continued)

(56) References Cited

U.S. PATENT DOCUMENTS 7,382,347 B2 6/2008 Sasaki et al.
7,605,789 B2 * 10/2009 Uchino ..... G09G 3/3233 315/169.3

(Continued)

FOREIGN PATENT DOCUMENTS

CN 1684558 A 10/2005
CN 101097677 A 1/2008

(Continued)

OTHER PUBLICATIONS

First Office Action issued in corresponding Chinese Application No. 2013107388117 dated May 6, 2015.

(Continued)

*Primary Examiner* — Kumar Patel
*Assistant Examiner* — Vinh Lam
(74) *Attorney, Agent, or Firm* — Bakerhostetler LLP

(57) ABSTRACT

The gate driving circuit according to the present disclosure may be connected to a row pixel unit which includes a row pixel driving module and a light emitting element connected to each other, the row pixel driving module including a driving transistor, a driving module and a compensation module, the compensation module being connected with a gate scanning signal and the driving module being connected with a driving level. The gate driving circuit may further include a row pixel control unit, which is configured to provide the gate scanning signal to the compensation module and provide the driving level to the driving module, so as to control the compensation module to compensate for (Continued)

a threshold voltage of the driving transistor and control the driving module to drive the light emitting element.

18 Claims, 6 Drawing Sheets

(58) Field of Classification Search
USPC ..... 345/531, 211–213, 76–78, 100; 257/40
See application file for complete search history.

(56) References Cited

U.S. PATENT DOCUMENTS

| | | | | |
|---|---|---|---|---|
| 8,289,261 | B2 | 10/2012 | Lee et al. | |
| 2006/0038500 | A1 | 2/2006 | Lee et al. | |
| 2006/0202977 | A1 | 9/2006 | Oh | |
| 2006/0291610 | A1 | 12/2006 | Lo et al. | |
| 2007/0091029 | A1* | 4/2007 | Uchino | G09G 3/3233 345/76 |
| 2007/0296662 | A1 | 12/2007 | Lee et al. | |
| 2009/0135166 | A1 | 5/2009 | Uchino et al. | |
| 2010/0134469 | A1* | 6/2010 | Ogura | G09G 3/3291 345/211 |
| 2010/0182227 | A1 | 7/2010 | Tsou | |
| 2010/0188385 | A1* | 7/2010 | Boiko | G11C 19/184 345/211 |
| 2010/0201659 | A1 | 8/2010 | Miyake et al. | |
| 2010/0207667 | A1 | 8/2010 | Kwon et al. | |
| 2011/0157112 | A1 | 6/2011 | Shibata et al. | |
| 2011/0164071 | A1 | 7/2011 | Chung et al. | |
| 2011/0279429 | A1 | 11/2011 | Kim et al. | |
| 2012/0287103 | A1* | 11/2012 | Wu | G09G 3/3233 345/211 |
| 2013/0307840 | A1* | 11/2013 | Lee | G09G 3/3233 345/212 |
| 2014/0085285 | A1* | 3/2014 | Kim | G09G 3/3266 345/211 |
| 2014/0169518 | A1 | 6/2014 | Kong et al. | |
| 2014/0176410 | A1 | 6/2014 | Ma et al. | |
| 2014/0240209 | A1 | 8/2014 | Zhang | |
| 2015/0062137 | A1* | 3/2015 | Yu | G09G 3/3233 345/531 |
| 2015/0077319 | A1 | 3/2015 | Yao et al. | |
| 2016/0064098 | A1 | 3/2016 | Han et al. | |
| 2016/0111065 | A1 | 4/2016 | Wang et al. | |

FOREIGN PATENT DOCUMENTS

| | | | |
|---|---|---|---|
| CN | 101122720 | | 2/2008 |
| CN | 101183508 | A | 5/2008 |
| CN | 101271667 | A | 9/2008 |
| CN | 101276547 | A | 10/2008 |
| CN | 101339737 | A | 1/2009 |
| CN | 101364392 | | 2/2009 |
| CN | 101556762 | A | 10/2009 |
| CN | 101556763 | A | 10/2009 |
| CN | 101770745 | A | 7/2010 |
| CN | 102298900 | A | 12/2011 |
| CN | 102592561 | | 7/2012 |
| CN | 102654972 | A | 9/2012 |
| CN | 102708824 | A | 10/2012 |
| CN | 102930822 | | 2/2013 |
| CN | 102956269 | A | 3/2013 |
| CN | 202917146 | | 5/2013 |
| CN | 103218970 | | 7/2013 |
| CN | 103236236 | | 8/2013 |
| CN | 203179475 | | 9/2013 |
| CN | 203179476 | | 9/2013 |
| CN | 103440840 | | 12/2013 |
| CN | 103714780 | | 4/2014 |
| CN | 103714781 | | 4/2014 |
| CN | 103730089 | | 4/2014 |
| EP | 2237253 | | 10/2010 |
| JP | 2007140318 | | 6/2007 |
| KR | 20060091465 | | 8/2006 |

OTHER PUBLICATIONS

International Search Report and Written Opinion issued in corresponding International Application No. PCT/CN2014/078725 dated Sep. 26, 2014.
Office Action in Chinese Patent Application No. 201310722407.0, dated Sep. 11, 2014.
Office Action in Chinese Patent Application No. 201310722407.0, dated Feb. 13, 2015.
International Search Report and Written Opinion in PCT International Application No. PCT/CN2014/076261, dated Sep. 29, 2014.
Office Action in Chinese Patent Application No. 201310745360.X, dated Sep. 12, 2014.
Office Action in Chinese Patent Application No. 201310745360.X, dated Mar. 30, 2015.
Office Action in Chinese Patent Application No. 201310745360.X, dated Jul. 30, 2015.
International Search Report and Written Opinion in PCT International Application No. PCT/CN2014/076258, dated Oct. 10, 2014.

* cited by examiner

GATE DRIVING CIRCUIT, GATE DRIVING METHOD, GATE ON ARRAY (GOA) CIRCUIT AND DISPLAY DEVICE

CROSS-REFERENCE TO RELATED APPLICATION

This application is the U.S. national phase of PCT Application No. PCT/CN2014/078725 filed on May 29, 2014, which claims priority to Chinese Patent Application No. 201310738811.7 filed on Dec. 26, 2013, the disclosures of which are incorporated in their entirety by reference herein.

TECHNICAL FIELD

The present disclosure relates to the field of display technology, in particular to a gate driving circuit, a gate driving method, a gate on array (GOA) circuit and a display device.

BACKGROUND

There is no gate on may (GOA, wherein gate driving circuits are directly formed on an array substrate) circuit provided in the related art which can provide a threshold voltage (Vth) compensation for pixels of an organic light-emitting electrode (OLED) display panel, but there only provides a GOA circuit which simply has a Vth compensation function designed for pixels or a GOA circuit having a single pulse.

Since most of OLED pixel designs are of a current control type, Vth non-uniformity inside an entire OLED display panel and a Vth shift generated after a long-term operation will decrease display uniformity of the OLED display panel. In order to improve a process integration of the OLED display panel and reduce costs at the same time, using an integrated gate driving technology is a development trend of the future. However, a Vth compensation pixel design of an OLED needs peripheral driving circuits to cooperate with it, therefore higher requirements are needed for the GOA.

SUMMARY

An object of the present disclosure is to provide a gate driving circuit, a gate driving method, a GOA circuit and a display device, to compensate for pixel threshold voltages and drive pixels simultaneously, thereby improving the degree of integration.

In order to achieve the above object, the present disclosure provides a gate driving circuit, connected to a row pixel unit which includes a row pixel driving module and a light emitting element connected to each other, the row pixel driving module including a driving transistor, a driving module and a compensation module, the compensation module being connected with a gate scanning signal and the driving module being connected with a driving level; wherein the gate driving circuit includes a row pixel control unit, which is configured to provide the gate scanning signal to the compensation module and provide the driving level to the driving module, so as to control the compensation module to compensate for a threshold voltage of the driving transistor and control the driving module to drive the light emitting element.

Alternatively, the row pixel control unit may include a start signal input end, a first control clock input end, a second control clock input end, a reset signal input end, an input clock end, a carry signal output end, a cutting-off control signal output end, an output level end, an output level pulling-down control end and a gate scanning signal output end;

the row pixel control unit may further include:

a pulling-up node potential pulling-up module, configured to pull a potential of a pulling-up node up to a high level, when a first control clock signal and a start signal are of a high level;

a storage capacitor, connected between the pulling-up node and the carry signal output end;

a pulling-up node potential pulling-down module, configured to pull the potential of the pulling-up node down to a first low level, when a potential of a first pulling-down node or a potential of a second pulling-down node is of a high level;

a first control clock switch, configured to set up a connection between the first control clock input end and the first pulling-down node when the first control clock signal is of a high level;

a second control clock switch, configured to set up a connection between the second control clock input end and the second pulling-down node when a second control clock signal is of a high level;

a first pulling-down node potential pulling-down module, configured to pull the potential of the first pulling-down node down to the first low level, when the potential of the pulling-up node or the potential of the second pulling-down node is of a high level;

a second pulling-down node potential pulling-down module, connected to the reset signal input end, configured to pull the potential of the second pulling-down node down to the first low level, when the potential of the pulling-up node or the potential of the first pulling-down node is of a high level;

a carry control module, configured to set up a connection between the carry signal output end and the second control clock input end, when the potential of the pulling-up node is of a high level;

a carry signal pulling-down module, configured to pull a potential of the carry signal down to the first low level, when the potential of the first pulling-down node or the potential of the second pulling-down node is of a high level;

a cutting-off control module, configured to set up a connection between the second control clock input end and the cutting-off control signal output end when the potential of the pulling-up node is of a high level; and set up a connection between the cutting-off control signal output end and the second low level output end when the potential of the first pulling-down node or the potential of the second pulling-down node is of a high level;

a feedback module, configured to transmit a cutting-off control signal to the pulling-up node potential pulling-up module and the pulling-up node potential pulling-down module, when the carry signal is of a high level;

a gate scanning signal control module, configured to set up a connection between the second control clock input end and the gate scanning signal output end, when the potential of the pulling-up node is of a high level;

an input clock switch, configured to set up a connection between the input clock end and the output level pulling-down control end, when the potential of the pulling-up node is of a high level;

a gate scanning signal pulling-down module, configured to pull a potential of the gate scanning signal down to a second low level, when the potential of the first pulling-down node or the potential of the second pulling-down node is of a high level;

an output level pulling-down control module, configured to pull a potential of the output level pulling-down control end down to the second low level, when the potential of the first pulling-down node or the potential of the second pulling-down node is of a high level;

an output level pulling-up module, configured to pull the output level up to a high level, when an output level pulling-down control end outputs the second low level;

an output level pulling-down module, configured to pull the output level down to the second low level, when the output level pulling-down control end outputs a high level.

Alternatively, the pulling-up node potential pulling-up module may include:

a first pulling-up node potential pulling-up transistor, a gate electrode and a first electrode of which are connected to the start signal input end, and a second electrode of which is connected to the feedback module; and a second pulling-up node potential pulling-up transistor, a gate electrode of which is connected to the first control clock input end, a first electrode of which is connected to the second electrode of the first puffing-up node potential pulling-up transistor, and a second electrode of which is connected to the pulling-up node;

the pulling-up node potential pulling-down module may include:

a first pulling-up node potential pulling-down transistor, a gate electrode of which is connected to the first pulling-down node, a first electrode of which is connected to the pulling-up node, and a second electrode of which is connected to the feedback module;

a second pulling-up node potential pulling-down transistor, a gate electrode of which is connected to the first pulling-down node, a first electrode of which is connected to the second electrode of the first pulling-up node potential pulling-down transistor, and a second electrode of which is connected with the first low level;

a third pulling-up node potential pulling-down transistor, a gate electrode of which is connected to the second pulling-down node, a first electrode of which is connected to the pulling-up node, and a second electrode of which is connected to the feedback module; and a fourth pulling-up node potential pulling-down transistor, a gate electrode of which is connected to the second pulling-down node, a first electrode of which is connected to the second electrode of the third pulling-up node potential pulling-down transistor, and a second electrode of which is connected with the first low level;

the first pulling-down node potential pulling-down module may include:

a first pulling-down transistor, a gate electrode of which is connected to the pulling-up node, a first electrode of which is connected to the first pulling-down node, and a second electrode of which is connected to the reset signal input end;

a second pulling-down transistor, a gate electrode of which is connected to the pulling-up node, a first electrode of which is connected to the second electrode of the first pulling-down transistor, and a second electrode of which is being connected with the first low level; and a third pulling-down transistor, a gate electrode of which is connected to the second pulling-down node, a first electrode of which is connected to the first pulling-down node, and a second electrode of which is connected with the first low level;

the second pulling-down node potential pulling-down module may include:

a fourth pulling-down transistor, a gate electrode of which is connected to the pulling-up node, a first electrode of which is connected to the second pulling-down node, and a second electrode of which is connected to the reset signal input end;

a fifth pulling-down transistor, a gate electrode of which is connected to the pulling-up node, a first electrode of which is connected to the second electrode of the fourth pulling-down transistor, and a second electrode of which is connected with the first low level; and a sixth pulling-down transistor, a gate electrode of which is connected to the first pulling-down node, a first electrode of which is connected to the second pulling-down node, and a second electrode of which is connected with the first low level.

Alternatively, the carry control module may include:

a carry control transistor, a gate electrode of which is connected to the pulling-up node, a first electrode of which is connected to the second control clock input end, and a second end of which is connected to the carry signal output end;

the carry signal pulling-down module may include:

a first carry signal pulling-down transistor, a gate electrode of which is connected to the first pulling-down node, a first electrode of which is connected to the carry signal output end, and a second electrode of which is connected with the first low level; and a second carry signal pulling-down transistor, a gate electrode of which is connected to the second pulling-down node, a first electrode of which is connected to the carry signal output end, and a second electrode of which is connected with the first low level;

the cutting-off control module may include:

a first cutting-off control transistor, a gate electrode of which is connected to the pulling-up node, a first electrode of which is connected to the second control clock input end, and a second electrode of which is connected to the cutting-off control signal output end;

a second cutting-off control transistor, a gate electrode of which is connected to the first pulling-down node, a first electrode of which is connected to the cutting-off control signal output end, and a second electrode of which is connected with the second low level; and a third cutting-off control transistor, a gate electrode of which is connected to the second pulling-down node, a first electrode of which is connected to the cutting-off control signal output end, and a second electrode of which is connected with the second low level;

the feedback module may include:

a feedback transistor, a gate electrode of which is connected to the carry signal output end, a first electrode of which is connected to the second electrode of the first pulling-up node potential pulling-up transistor, and a second electrode of which is connected to the cutting-off control signal output end.

Alternatively, the gate scanning signal control module may include:

a gate scanning control transistor, a gate electrode of which is connected to the pulling-up node, a first electrode of which is connected with the second control clock signal, and a second electrode of which is connected to the gate scanning signal output end;

the gate scanning signal pulling-down module may include:

a first output pulling-down transistor, a gate electrode of which is connected to the first pulling-down node, a first electrode of which is connected to the gate scanning signal output end, and a second electrode of which is connected with the second low level; and a second output pulling-down transistor, a gate electrode of which is connected to the second pulling-down node, a first electrode of which is connected to the gate scanning signal output end, and a second electrode of which is connected with the second low level;

the output level pulling-up module may include:

an output level pulling-up transistor, a gate electrode and first electrode of which are connected with a high level, and a second electrode of which is connected to the output level end;

the output level pulling-down control module may include:

a first pulling-down control transistor, a gate electrode of which is connected to the first pulling-down node, a first electrode of which is connected to the output level pulling-down control end, and a second electrode of which is connected with the second low level; and a second pulling-down control transistor, a gate electrode of which is connected to the second pulling-down node, a first electrode of which is connected to the output level pulling-down control end, and a second electrode of which is connected with the second low level;

the output level pulling-down module may include:

an output level pulling-down transistor, a gate electrode of which is connected to the output level pulling-down control end, a first electrode of which is connected to the output level end, and a second electrode of which is connected with the second low level.

Alternatively, the input clock switch may include an input transistor, a gate electrode of which is connected to the pulling-up node, a first electrode of which is connected to the input clock end, and a second electrode of which is connected to output level pulling-down control end.

Alternatively, the first control clock signal and the second control clock signal may be inverted.

The present disclosure further provides a gate driving method, applied in the above gate driving circuit, the method including:

pulling, by the second control clock switch, the potential of the second pulling-down node up to a high level; pulling, by the pulling-up node potential pulling-down module, the potential of the pulling-up node down to the first low level; pulling, by the first pulling-down node potential pulling-down module, the potential of the first pulling-down node down to the first low level; controlling, by output level pulling-up module, the output level end to output a high level; and controlling, by the gate scanning signal pulling-down module, the gate scanning signal output end to output the second low level, in a first stage, during which the start signal is of a low level, the first control clock signal is of a low level, the second control clock signal is of a high level;

pulling, by the pulling-up node potential pulling-up module, the potential of the pulling-up node up to a high level; pulling, by the first pulling-down node potential pulling-down module, the potential of the first pulling-down node down to the first low level; pulling, by the second pulling-down node potential pulling-down module, the potential of the second pulling-down node down to the first low level; and turning on the input clock switch, in a second stage, during which the start signal is of a high level, the first control clock signal is of a high level, the second control clock signal is of a low level, the input clock signal is of a low level, and the signals outputted by the output level end and gate scanning signal output end remain the same;

maintaining the potential of the pulling-up node at a high level; puffing, by the first pulling-down node potential pulling-down module, the potential of the first pulling-down node down to the first low level; pulling, by the second pulling-down node potential pulling-down module, the potential of the second pulling-down node down to the first low level; turning on the input clock switch; outputting, by the gate scanning signal output end, a high level; outputting, by the output level pulling-down control end, a high level; and controlling, by the output level pulling-down module, the output level end to output the second low level, in a third stage, during which the start signal is of a low level, the first control clock signal is of a low level, the input clock signal is of a high level, and the second control clock signal is of a high level;

pulling, by the pulling-up node potential pulling-down module, the potential of the pulling-up node down to the first low level; turning on the second control clock switch, thereby pulling the potential of the second pulling-down node up to a high level; pulling, by the first pulling-down node potential pulling-down module, the potential of the first pulling-down node down to the first low level; turning off the input clock switch; pulling, by the gate scanning signal pulling-down module, the potential of the gate scanning signal down to the second low level; controlling, by the output level pulling-down control module, the output level pulling-down control end to output the second low level; and controlling, by the output level pulling-up module, the output level end to output a high level, in a fourth stage, during which the start signal is of a low level, the first control clock signal is of a high level, the second control clock signal is of a low level.

The present disclosure further provides a Gate on array (GOA) circuit, including the above multi-level gate driving circuits;

each level gate driving circuit further includes a driving control signal output end;

the start signal input end of a first level gate driving circuit and the start signal input end of a second level gate driving circuit are inputted with the start signal;

the start signal input end of an N-th level gate driving circuit is connected to the carry signal output end of an (N−2)-th level gate driving circuit, where N is an integer greater than or equal to 3 and less than or equal to M, and M is a number of levels of the gate driving circuits included in the GOA circuit;

except for the last level gate driving circuit, the driving control signal output end of each level gate driving circuit is connected to the output level end of a next level gate driving circuit;

the reset signal input end of a K-th level gate driving circuit is connected to the cutting-off control signal output end of a (K+2)-th level gate driving circuit, where K is an integer greater than or equal to 1 and less than M−1;

the first control signal input ends of odd-number-level gate driving circuits are connected with a first external control signal, and the second control signal input ends of the odd-number-level gate driving circuits are connected with a second external control signal;

the first control signal input ends of even-number-level gate driving circuits are connected with a third external control signal, and the second control signal input ends of odd-number-level gate driving circuits are connected with a fourth external control signal.

Alternatively, the first control signal and the second control signal may be inverted;

the third control signal and the fourth control signal may be inverted.

Alternatively, the third external control signal may be of one clock cycle later than the first external control signal;

the fourth external control signal may be of one clock cycle later than the second external control signal.

Alternatively, the input clock signal inputted to a 2n-th level gate driving circuit and the input clock signal inputted to a (2n+2)-th level gate driving circuit may be inverted;

the input clock signal inputted to a (2n−1)-th level gate driving circuit and the input clock signal inputted to a (2n+1)-th level gate driving circuit may be inverted;

the input clock signal inputted to the 2n-th level gate driving circuit may be of one clock cycle later than the input clock signal inputted to the (2n−1)-th level gate driving circuit;

the input clock signal inputted to the (2n+2)-th level gate driving circuit may be of one clock cycle later than the input clock signal inputted to the (2n+1)-th level gate driving circuit;

where n is an integer greater than or equal to 1, and 2n+2 is less than or equal to M.

The present disclosure further provides a display device, including the above gate driving circuit.

Alternatively, the display device may be an organic light-emitting diode (OLED) display device or a low-temperature polysilicon (LTPS) display device.

Compared with the related art, in the gate driving circuit, the gate driving method, the GOA circuit and the display device according to the present disclosure, they are configured to control the compensation module to compensate for a threshold voltage of the driving transistor and control the driving module to drive the row pixel control unit of the light emitting element, which can compensate for pixel threshold voltages and drive pixels simultaneously. Applying the gate driving circuit and the GOA circuit according to the present disclosure in the OLED display panel can improve the process integration of the OLED display panel and reduce costs. Moreover, in the GOA circuit according to the present disclosure, the output level of a next level gate driving circuit and the switch signal of an immediately previous level gate driving circuit use a same signal, which can simplify the circuit.

DETAILED DESCRIPTION

In order to achieve the above object, the present disclosure provides a gate driving circuit, connected to a row pixel unit which includes a row pixel driving module and a light emitting element connected to each other, the row pixel driving module including a driving transistor, a driving module and a compensation module, the compensation module being connected with a gate scanning signal and the driving module being connected with a driving level; wherein the gate driving circuit includes a row pixel control unit, which is configured to provide the gate scanning signal to the compensation module and provide the driving level to the driving module, so as to control the compensation module to compensate for a threshold voltage of the driving transistor and control the driving module to drive the light emitting element.

In the gate driving circuit according to the present disclosure, it is configured to control the compensation module to compensate for a threshold voltage of the driving transistor and control the driving module to drive the row pixel control unit of the light emitting element, which can compensate for pixel threshold voltages.

Applying the gate driving circuit according to the present disclosure in the OLED display panel can improve the process integration of the OLED display panel and reduce costs.

Figure 1A:
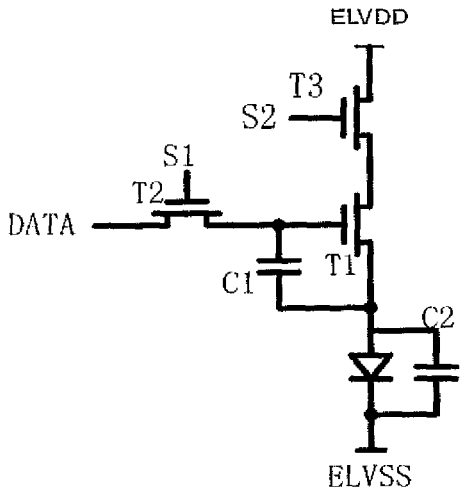
FIG. 1A is a circuit diagram showing a example of a row pixel driving module included in a row pixel unit connected to a gate driving circuit according to the present disclosure.

As shown in FIG. 1A, the row pixel driving module according to an embodiment of the present disclosure includes a driving transistor T1, a compensation transistor T2, a driving control transistor T3, a first capacitor C1 and a second capacitor C2;

the compensation transistor T2 includes a compensation module; the driving control transistor T3 includes a driving control module;

a gate electrode of the compensation transistor T2 is connected with a gate scanning signal S1, a second electrode of the compensation transistor T2 is connected with a data signal DATA; a gate electrode of the driving control transistor T3 is connected with a driving control signal S2, a first electrode of the driving control transistor T3 is connected with an output level ELVDD;

a cathode of the OLED is connected with a voltage level ELVSS.

Figure 1B:
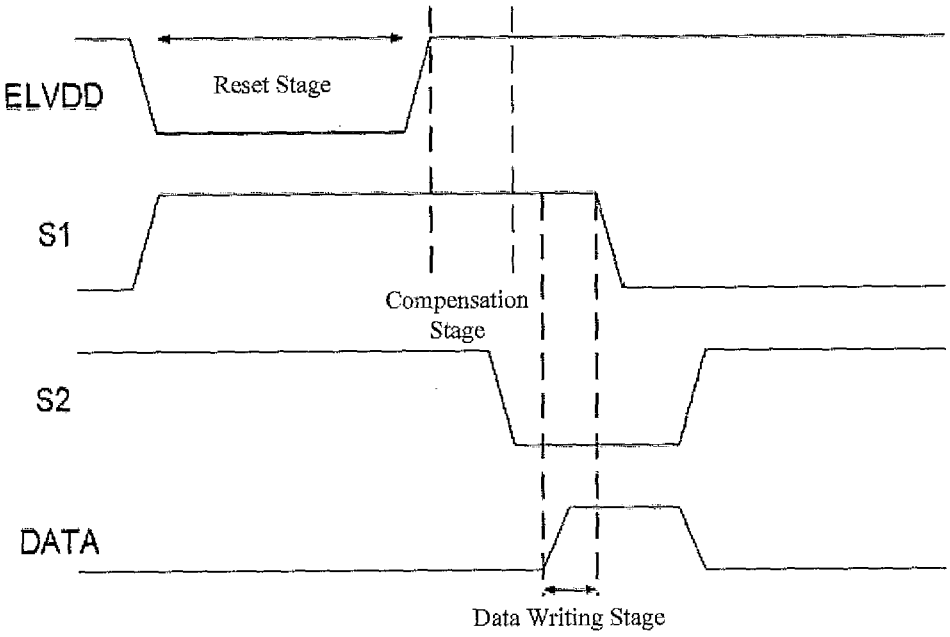
FIG. 1B is a diagram showing timing sequences of the row pixel driving module shown in FIG. 1A.

FIG. 1B is a diagram showing timing sequences of the row pixel driving module shown in FIG. 1A.

The present disclosure provides a GOA unit which can cooperate with the Vth compensation pixel design. The GOA unit can output two signals, one output signal is a high level signal of a pulse which can be a gate scanning signal (S1 as shown in FIG. 1A), the other output signal is a low level signal of the pulse which can be an ELVDD (as shown in FIG. 1A). Taking a currently used 3T2C threshold compensation OLED pixel as an example, there still needs a low level pulse signal S2 which functions as a switch of ELVDD signal to drive the pixel. The low level pulse signal S2 can be used as the driving control signal. In a GOA circuit, the low level pulse signal S2 of an N-th row and the ELVDD signal of an (N+1)-th row can use a same signal, which can simplify the circuit. And the pixel threshold compensation and the pixel driving can be achieved by adjusting the timing sequences of a start signal and a clock signal.

Figure 1C:
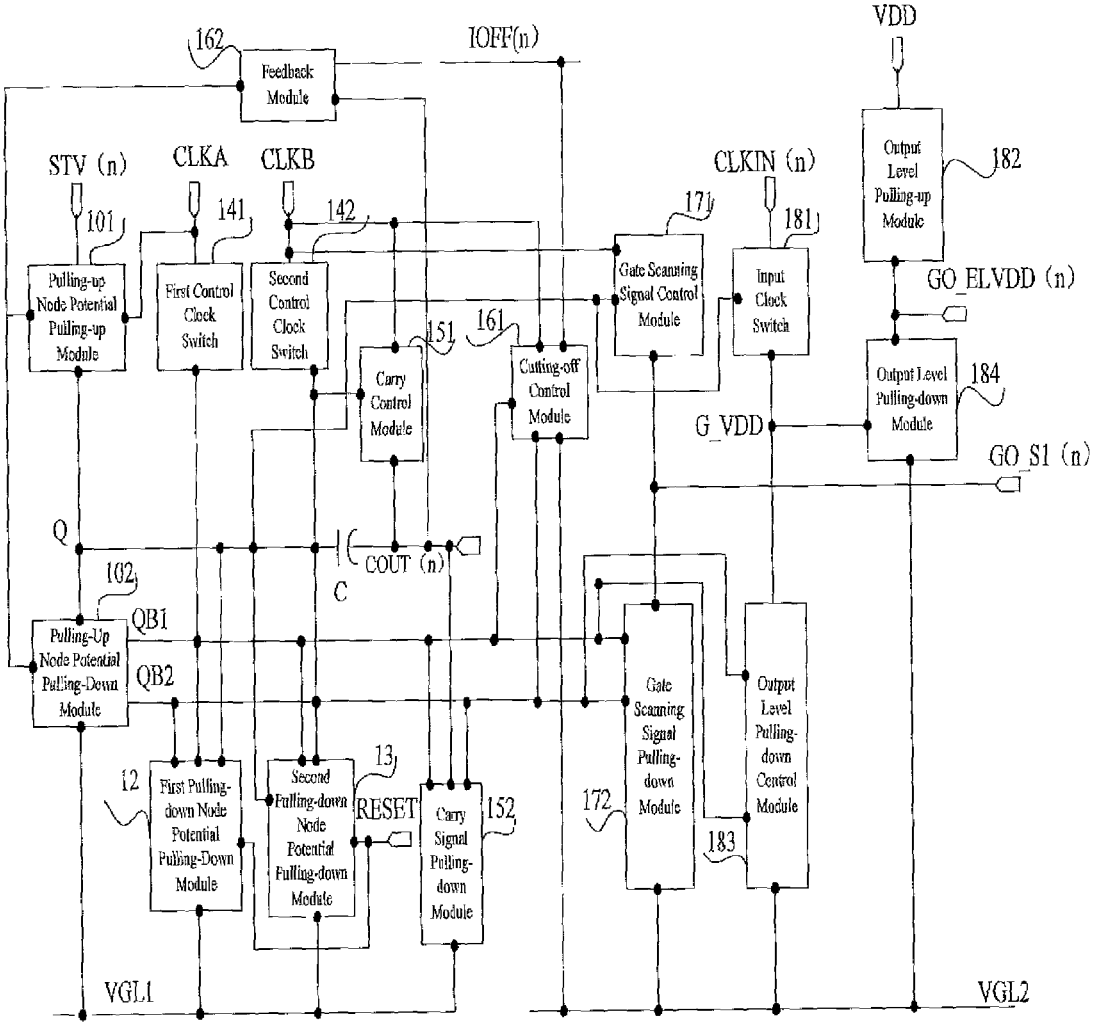
FIG. 1C is a block diagram showing a structure of the gate driving circuit according to an embodiment of the present disclosure.

As shown in FIG. 1C, in the gate driving circuit according to an embodiment of the present disclosure:

the row pixel control unit includes a start signal input end STV, a first control clock input end CLKA, a second control clock input end CLKB, a reset signal input end RESET, an input clock end CLKIN (n), a carry signal output end COUT (n), a cutting-off control signal output end IOFF (n), an output level end GO_ELVDD (n), an output level pulling-down control end G_VDD and a gate scanning signal output end GO_S1 (n);

the row pixel control unit further includes:

a pulling-up node potential pulling-up module 101, configured to pull a potential of a pulling-up node up to a high level, when a first control clock signal and a start signal are of a high level;

a storage capacitor C, connected between the pulling-up node Q and the carry signal output end COUT (n);

a pulling-up node potential pulling-down module 102, configured to pull the potential of the pulling-up node Q down to a first low level VGL1, when a potential of a first pulling-down node QB1 or a potential of a second pulling-down node QB2 is of a high level;

a first control clock switch 141, configured to set up a connection between the first control clock input end CLKA and the first pulling-down node QB1, when the first control clock signal is of a high level;

a second control clock switch 142, configured to set up a connection between the second control clock input end CLKB and the second pulling-down node QB2, when a second control clock signal is of a high level;

a first pulling-down node potential pulling-down module 12, configured to pull the potential of the first pulling-down node QB1 down to the first low level VGL1, when the potential of the pulling-up node Q or the potential of the second pulling-down node QB2 is of a high level;

a second pulling-down node potential pulling-down module 13, connected to the reset signal input end RESET, configured to pull the potential of the second pulling-down node QB2 down to the first low level VGL1, when the potential of the pulling-up node Q or the potential of the first pulling-down node QB1 is of a high level;

a carry control module 151, configured to set up a connection between the carry signal output end COUT (n) and the second control clock input end CLKB, when the potential of the pulling-up node Q is of a high level;

a carry signal pulling-down module 152, configured to pull a potential of the carry signal down to the first low level VGL1, when the potential of the first pulling-down node QB1 or the potential of the second pulling-down node QB2 is of a high level;

a cutting-off control module 161, configured to set up a connection between the second control clock input end CLKB and the cutting-off control signal output end IOFF (n), when the potential of the pulling-up node Q is of a high level; and set up a connection between the cutting-off control signal output end IOFF (n) and the second low level output end VGL2, when the potential of the first pulling-down node QB1 or the potential of the second pulling-down node QB2 is of a high level;

a feedback module 162, configured to transmit a cutting-off control signal to the pulling-up node potential pulling-up module 101 and the pulling-up node potential pulling-down module 102, when the carry signal is of a high level;

a gate scanning signal control module 171, configured to set up a connection between the second control clock input end CLKB and the gate scanning signal output end GO_S1 (n), when the potential of the pulling-up node Q is of a high level;

an input clock switch 181, configured to set up a connection between the input clock end CLKIN (n) and the output level pulling-down control end G_VDD, when the potential of the pulling-up node Q is of a high level;

a gate scanning signal pulling-down module 172, configured to pull a potential of the gate scanning signal down to a second low level VGL2, when the potential of the first pulling-down node QB1 or the potential of the second pulling-down node QB2 is of a high level;

an output level pulling-up module 182, configured to pull the output level up to a high level, when an output level pulling-down control end G_VDD outputs the second low level VGL2;

an output level pulling-down control module 183, configured to pull a potential of the output level pulling-down control end G_VDD down to the second low level VGL2, when the potential of the first pulling-down node QB1 or the potential of the second pulling-down node QB2 is of a high level;

an output level pulling-down module 184, configured to pull the output level down to the second low level VGL2, when the output level pulling-down control end G_VDD outputs a high level.

The gate driving circuit according to the embodiment uses two pulling-down nodes, i.e., the first pulling-down node QB1 and the second pulling-down node QB2, to pull down the output level. The first pulling-down node QB1 and the second pulling-down node QB2 are both alternating currents (AC) in the condition of not outputting and are inverted. Therefore, the threshold shift can be reduced, and there is no gap in the pulling-down of outputs, which can improve stability and reliability.

When the gate driving circuit according to the embodiment is working, the pixel threshold compensation and the pixel driving can be achieved by adjusting the start signal, the first control clock signal, the second control clock signal and the input clock signal.

All the transistors employed in the present disclosure can be thin film transistors (TFTs) or field effect transistors (FETs) or other devices with same characteristics. In embodiments of the present disclosure, in order to distinguish two electrodes other than a gate electrode of a transistor, one is called as a source electrode, and the other is called as a drain electrode. In addition, according to the characteristics, transistors can be divided into N-type transistors or P-type transistors. In the driving circuit provided by embodiments of the present disclosure, the specific use of N-type transistors or P-type transistors can be made by a person skilled in the art without creative work, which therefore will fall within the scope of the present disclosure.

In the driving circuit provided by embodiments of the present disclosure, a first electrode of a N-type transistor may be a source electrode, and a second electrode of the N-type transistor may be a drain electrode; a first electrode of a P-type transistor may be a drain electrode, and a second electrode of the P-type transistor may be a source electrode.

Figure 2:
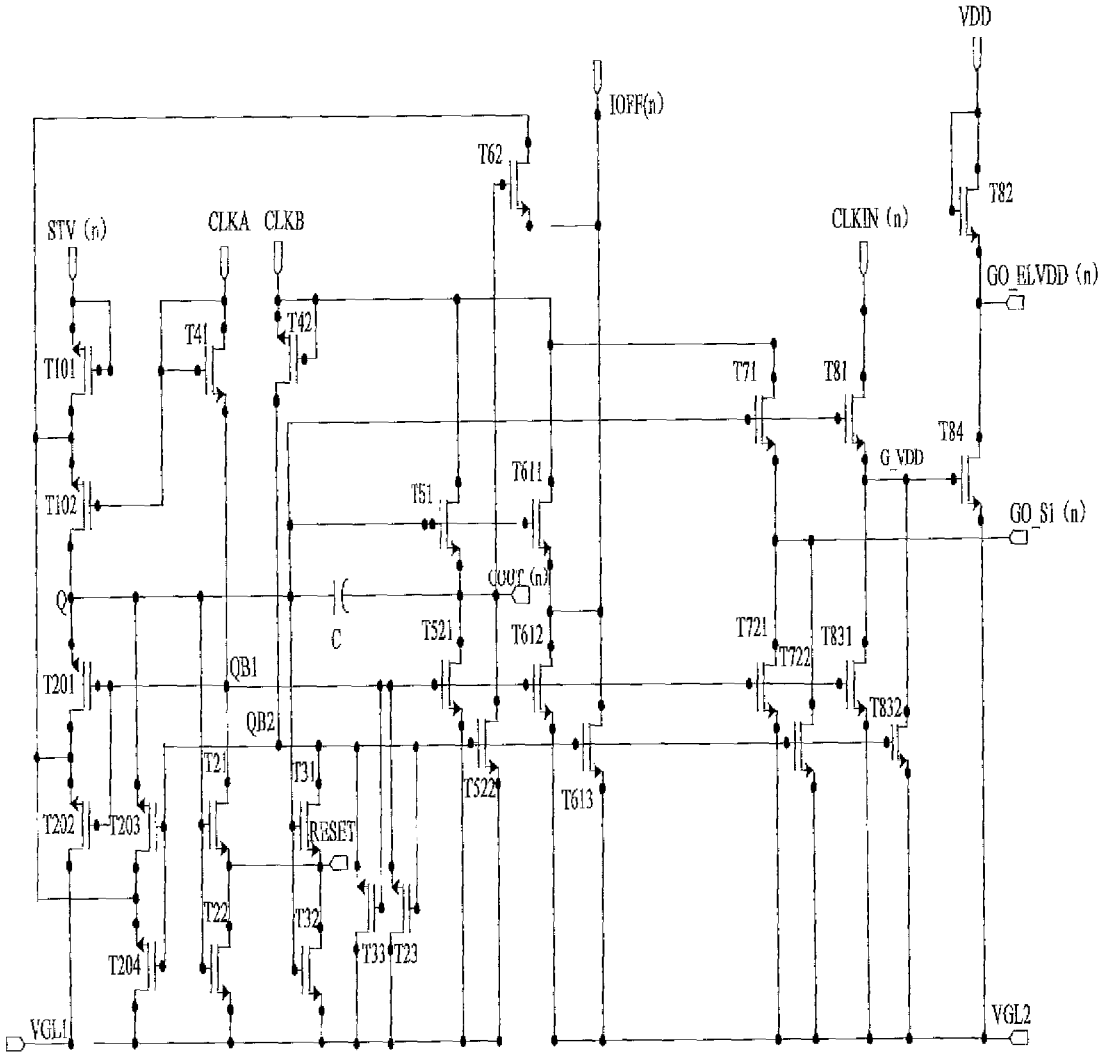
FIG. 2 is a circuit diagram showing a gate driving circuit according to an embodiment of the present disclosure.

Specifically, as shown in FIG. 2, in the gate driving circuit according to embodiments of the present disclosure, the pulling-up node potential pulling-up module 101 includes:

a first pulling-up node potential pulling-up transistor T101, a gate electrode and a first electrode of which are connected to the start signal input end STV, and a second electrode of which is connected to the feedback module 162; and a second pulling-up node potential pulling-up transistor T102, a gate electrode of which is connected to the first control clock input end CLKA, a first electrode of which is connected to the second electrode of the first pulling-up node potential pulling-up transistor T101, and a second electrode of which is connected to the pulling-up node Q;

the pulling-up node potential pulling-down module 102 includes:

a first pulling-up node potential pulling-down transistor T201, a gate electrode of which is connected to the first pulling-down node QB1, a first electrode of which is connected to the pulling-up node Q, and a second electrode of which is connected to the feedback module 162;

a second pulling-up node potential pulling-down transistor T202, a gate electrode of which is connected to the first pulling-down node QB1, a first electrode of which is connected to the second electrode of the first pulling-up node potential pulling-down transistor T201, and a second electrode of which is connected with the first low level VGL1;

a third pulling-up node potential pulling-down transistor T203, a gate electrode of which is connected to the second pulling-down node QB2, a first electrode of which is connected to the pulling-up node Q, and a second electrode of which is connected to the feedback module 162; and a fourth pulling-up node potential pulling-down transistor T204, a gate electrode of which is connected to the second pulling-down node QB2, a first electrode of which is connected to the second electrode of the third pulling-up node potential pulling-down transistor T203, and a second electrode of which is connected with the first low level VGL1;

the first pulling-down node potential pulling-down module 12 includes:

a first pulling-down transistor T21, a gate electrode of which is connected to the pulling-up node Q, a first electrode of which is connected to the first pulling-down node QB1, and a second electrode of which is connected to the reset signal input end RESET;

a second pulling-down transistor T22, a gate electrode of which is connected to the pulling-up node Q, a first electrode of which is connected to the second electrode of the first pulling-down transistor T21, and a second electrode of which is being connected with the first low level VGL1; and a third pulling-down transistor T23, a gate electrode of which is connected to the second pulling-down node QB2, a first electrode of which is connected to the first pulling-down node QB1, and a second electrode of which is connected with the first low level VGL1;

the second pulling-down node potential pulling-down module 13 includes:

a fourth pulling-down transistor T31, a gate electrode of which is connected to the pulling-up node Q, a first electrode of which is connected to the second pulling-down node QB2, and a second electrode of which is connected to the reset signal input end RESET;

a fifth pulling-down transistor T32, a gate electrode of which is connected to the pulling-up node Q, a first electrode of which is connected to the second electrode of the third pulling-down transistor T31, and a second electrode of which is connected with the first low level VGL1; and a sixth pulling-down transistor T33, a gate electrode of which is connected to the first pulling-down node QB1, a first electrode of which is connected to the second pulling-down node QB2, and a second electrode of which is connected with the first low level VGL1.

As shown in FIG. 2, the carry control module 151 includes:

a carry control transistor T51, a gate electrode of which is connected to the pulling-up node Q, a first electrode of which is connected to the second control clock input end CLKB, and a second end of which is connected to the carry signal output end COUT (n);

the carry signal pulling-down module 152 includes:

a first carry signal pulling-down transistor T521, a gate electrode of which is connected to the first pulling-down node QB1, a first electrode of which is connected to the carry signal output end COUT (n), and a second electrode of which is connected with the first low level VGL1; and a second carry signal pulling-down transistor T522, a gate electrode of which is connected to the second pulling-down node QB2, a first electrode of which is connected to the carry signal output end COUT (n), and a second electrode of which is connected with the first low level VGL1;

the cutting-off control module 161 includes:

a first cutting-off control transistor T611, a gate electrode of which is connected to the pulling-up node Q, a first electrode of which is connected to the second control clock input end CLKB, and a second electrode of which is connected to the cutting-off control signal output end IOFF (n);

a second cutting-off control transistor T612, a gate electrode of which is connected to the first pulling-down node QB1, a first electrode of which is connected to the cutting-off control signal output end IOFF (n), and a second electrode of which is connected with the second low level VGL2; and a third cutting-off control transistor T613, a gate electrode of which is connected to the second pulling-down node QB2, a first electrode of which is connected to the cutting-off control signal output end IOFF (n), and a second electrode of which is connected with the second low level VGL2;

the feedback module 162 includes:

a feedback transistor T62, a gate electrode of which is connected to the carry signal output end COUT (n), a first electrode of which is connected to the second electrode of the first pulling-up node potential pulling-up transistor T101, and a second electrode of which is connected to the cutting-off control signal output end IOFF (n).

As shown in FIG. 2, the gate scanning signal control module 171 includes:

a gate scanning control transistor T71, a gate electrode of which is connected to the pulling-up node Q, a first electrode of which is connected with the second control clock signal CLKB, and a second electrode of which is connected to the gate scanning signal output end GO_S1 (n);

the gate scanning signal pulling-down module 172 includes:

a first output pulling-down transistor T721, a gate electrode of which is connected to the first pulling-down node QB1, a first electrode of which is connected to the gate scanning signal output end GO_S1 (n), and a second electrode of which is connected with the second low level VGL2; and a second output pulling-down transistor T722, a gate electrode of which is connected to the second pulling-down node QB2, a first electrode of which is connected to the gate scanning signal output end GO_S1 (n), and a second electrode of which is connected with the second low level VGL2;

the input clock switch 181 includes:

an input transistor T81, a gate electrode of which is connected to the pulling-up node Q, a first electrode of which is connected to an input clock end CLKIN, a second electrode of which is connected to the output level pulling-down control end G_VDD;

the output level pulling-up module 182 includes:

an output level pulling-up transistor T82, a gate electrode and first electrode of which are connected with a high level VDD, and a second electrode of which is connected to the output level end GO_ELVDD (n);

the output level pulling-down control module 183 includes:

a first pulling-down control transistor T831, a gate electrode of which is connected to the first pulling-down node QB1, a first electrode of which is connected to the output level pulling-down control end G_VDD, and a second electrode of which is connected with the second low level VGL2; and a second pulling-down control transistor T832, a gate electrode of which is connected to the second pulling-down node QB2, a first electrode of which is connected to the output level pulling-down control end G_VDD, and a second electrode of which is connected with the second low level VGL2;

the output level pulling-down module 184 includes:

an output level pulling-down transistor T84, a gate electrode of which is connected to the output level pulling-down control end G_VDD, a first electrode of which is connected to the output level end GO_ELVDD (n), and a second electrode of which is connected with the second low level VGL2.

When implemented, the first control clock signal and second control clock signal may be inverted.

As shown in FIG. 2, the first control clock switch 141 includes:

a first control transistor T41, a gate electrode and a first electrode of which are connected to the first control clock input end CLKA, and a second electrode of which is connected to the first pulling-down node QB1.

The second control clock switch 142 includes:

a second control transistor T42, a gate electrode and a first electrode of which are connected to the second control clock input end CLKB, and a second electrode of which is connected to the second pulling-down node QB2.

The storage capacitor C is connected between the pulling-up node Q and the carry signal output end COUT (n).

In the embodiment as shown in FIG. 2, T101, T102, T42, T201, T202, T203 and T204 are P-type transistors, T21, T22, T31, T32, T41, T51, T521, T522, T611, T612, T613, T62, T71, T721, T722, T81, T82, T831, T832 and T84 are N-type transistors. In other embodiments, the type of the transistors can be changed as long as they can achieve the same effect of controlling the connection and disconnection.

An embodiment of the present disclosure further provides a gate driving method, applied in the above gate driving circuits, including:

pulling, by the second control clock switch, the potential of the second pulling-down node up to a high level; pulling, by the pulling-up node potential pulling-down module, the potential of the pulling-up node down to the first low level; pulling, by the first pulling-down node potential pulling-down module, the potential of the first pulling-down node down to the first low level; controlling, by output level pulling-up module, the output level end to output a high level; and controlling, by the gate scanning signal pulling-down module, the gate scanning signal output end to output the second low level, in a first stage, during which the start signal is of a low level, the first control clock signal is of a low level, the second control clock signal is of a high level;

pulling, by the pulling-up node potential pulling-up module, the potential of the pulling-up node up to a high level; pulling, by the first pulling-down node potential pulling-down module, the potential of the first pulling-down node down to the first low level; pulling, by the second pulling-down node potential pulling-down module, the potential of the second pulling-down node down to the first low level; and turning on the input clock switch, in a second stage, during which the start signal is of a high level, the first control clock signal is of a high level, the second control clock signal is of a low level, the input clock signal is of a low level, and the signals outputted by the output level end and gate scanning signal output end remain the same;

maintaining the potential of the pulling-up node at a high level; pulling, by the first pulling-down node potential pulling-down module, the potential of the first pulling-down node down to the first low level; pulling, by the second pulling-down node potential pulling-down module, the potential of the second pulling-down node down to the first low level; turning on the input clock switch; outputting, by the gate scanning signal output end, a high level; outputting, by the output level pulling-down control end, a high level; and controlling, by the output level pulling-down module, the output level end to output the second low level, in a third stage, during which the start signal is of a low level, the first control clock signal is of a low level, the second control clock signal is of a high level, and the input clock signal is of a high level;

pulling, by the pulling-up node potential pulling-down module, the potential of the pulling-up node down to the first low level; turning on the second control clock switch, thereby pulling the potential of the second pulling-down node up to a high level; pulling, by the first pulling-down node potential pulling-down module, the potential of the first pulling-down node down to the first low level; turning off the input clock switch; pulling, by the gate scanning signal pulling-down module, the potential of the gate scanning signal down to the second low level; controlling, by the output level pulling-down control module, the output level pulling-down control end to output the second low level; and controlling, by the output level pulling-up module, the output level end to output a high level, in a fourth stage, during which the start signal is of a low level, the first control clock signal is of a high level, the second control clock signal is of a low level.

An embodiment of the present disclosure further provides a GOA circuit, including multi-level gate driving circuits described above;

each level gate driving circuit further includes a driving control signal output end;

the start signal input end of a first level gate driving circuit and the start signal input end of a second level gate driving circuit are inputted with the start signal;

the start signal input end of an N-th level gate driving circuit is connected to the carry signal output end of an (N−2)-th level gate driving circuit, where N is an integer greater than or equal to 3 and less than or equal to M, and M is a number of levels of the gate driving circuits included in the GOA circuit;

except for the last level gate driving circuit, the driving control signal output end of each level gate driving circuit is connected to the output level end of a next level gate driving circuit;

the reset signal input end of a K-th level gate driving circuit is connected to the cutting-off control signal output end of a (K+2)-th level gate driving circuit, where K is an integer greater than or equal to 1 and less than M−1;

the first control signal input ends of odd-number-level gate driving circuits are connected with a first external control signal, and the second control signal input ends of the odd-number-level gate driving circuits are connected with a second external control signal;

the first control signal input ends of even-number-level gate driving circuits are connected with a third external control signal, and the second control signal input ends of odd-number-level gate driving circuits are connected with a fourth external control signal.

Moreover, the third external control signal is of one clock cycle later than the first external control signal;

the fourth external control signal is of one clock cycle later than the second external control signal.

The input clock signal inputted to a 2n-th level gate driving circuit and the input clock signal inputted to a (2n+2)-th level gate driving circuit are inverted;

the input clock signal inputted to a (2n−1)-th level gate driving circuit and the input clock signal inputted to a (2n+1)-th level gate driving circuit are inverted;

the input clock signal inputted to the 2n-th level gate driving circuit is of one clock cycle later than the input clock signal inputted to the (2n−1)-th level gate driving circuit; where n is an integer greater than or equal to 1, and 2n+2 is less than or equal to M.

In the GOA circuit according to the present disclosure, the driving control signal of each level gate driving circuit and the output level of next gate driving circuit use a same signal, which can simplify the circuit.

Figure 3:
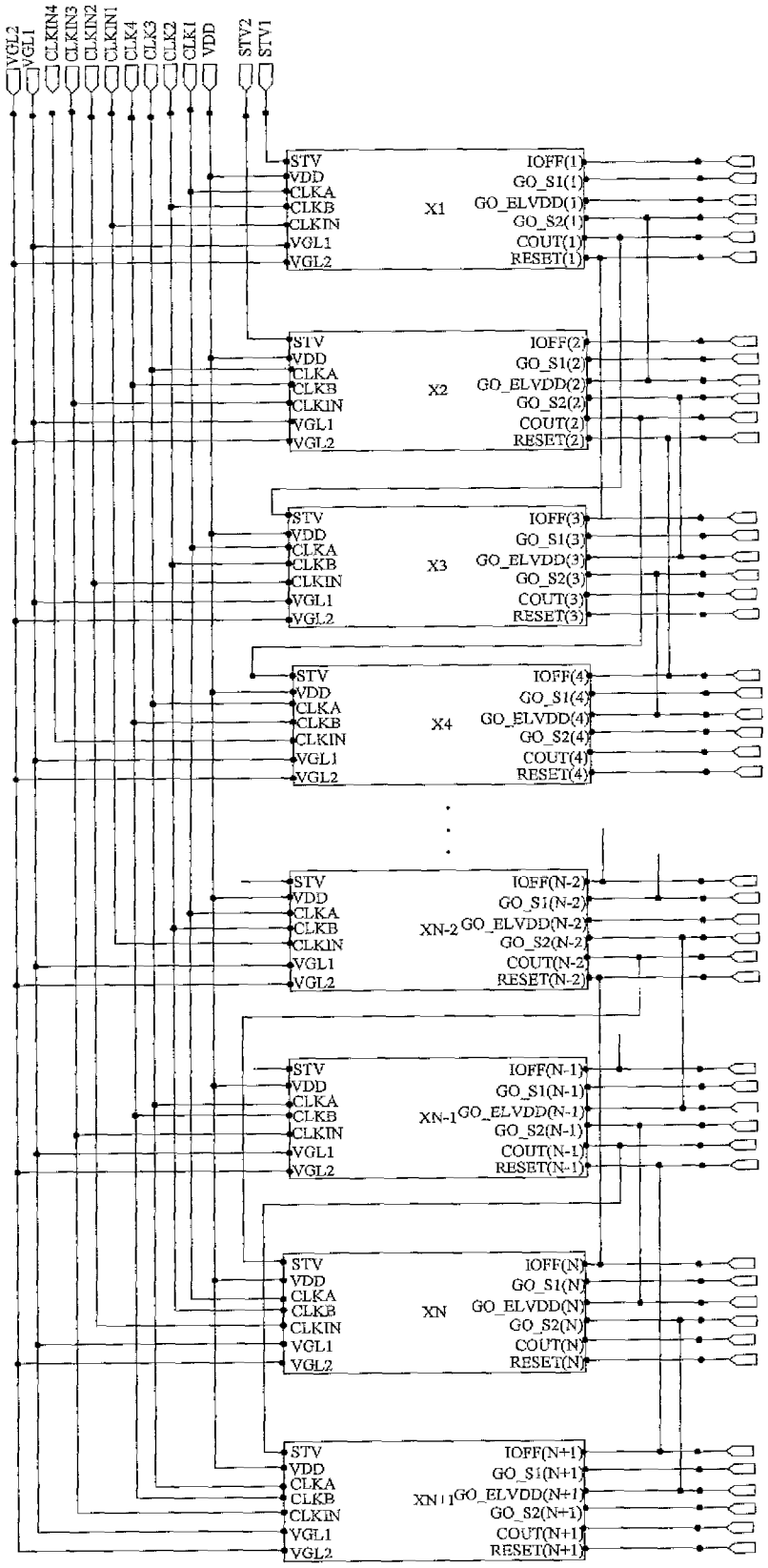
FIG. 3 is a diagram showing a structure of a GOA circuit according to an embodiment of the present disclosure.

As shown in FIG. 3, according to a specific embodiment, the GOA circuit includes (N+1) level gate driving circuit, where N is an integer greater than or equal to 7;

a start signal input end STV of a first level gate driving circuit is inputted with the first start signal STV1;

a start signal input end STV of a second level gate driving circuit is inputted with the second start signal STV2;

a start signal input end STV of an M-th level gate driving circuit is connected to a carry signal output end COUT (M−1) of an (M−1)-th level gate driving circuit, where M is greater than 2 and less than (N+1);

except for a (N+1)th level gate driving circuit, a driving control signal output end IOFF (J) of a J-th level gate driving circuit is connected to an output level end GO_ELVDD (J+1) of a (J+1) level gate driving circuit, where J is a positive integer less than (N+1);

a reset signal input end RESET (K) of a K-th level gate driving circuit is connected to a cutting-off control signal output end IOFF (K+2) of a (K+2)-th level gate driving circuit, where K is an integer greater than or equal to 1 and less than N;

first control clock input ends CLKA of odd-number-level gate driving circuits are connected with a first control clock signal CLK1, and second control clock input ends CLKB of odd-number-level gate driving circuits are connected with a second control clock signal CLK2; CLK1 and CLK2 are inverted;

first control clock input ends CLKA of even-number-level gate driving circuits are connected with a third control clock signal CLK3, and second control clock input ends CLKB of even-number-level gate driving circuits are connected with a fourth control clock signal CLK4; CLK3 and CLK4 are inverted;

the third external control signal CLK3 is of one clock cycle later than the first external control signal CLK1;

the fourth external control signal CLK4 is of one clock cycle later than the second external control signal CLK2;

an input clock end CLKIN of a (2n−1)-th level gate driving circuit is inputted with a first input clock signal CLKIN1;

an input clock signal end CLKIN of (2n+1)-th level gate driving circuit is inputted with a second input clock signal CLKIN2;

an input clock end CLKIN of a (2n)-th level gate driving circuit is inputted with a third input clock signal CLKIN3;

an input clock end CLKIN of a (2n+2)-th level gate driving circuit is inputted with a fourth input clock signal CLKIN4;

CLKIN1 and CLKIN2 are inverted;

CLKIN3 and CLKIN4 are inverted;

CLKIN3 is of one clock cycle later than CLKIN1;

CLKIN4 is of one clock cycle later than CLKIN2;

where n is an integer greater than or equal to 1, and 2n+2 is less than or equal to N+1.

Figure 4A:
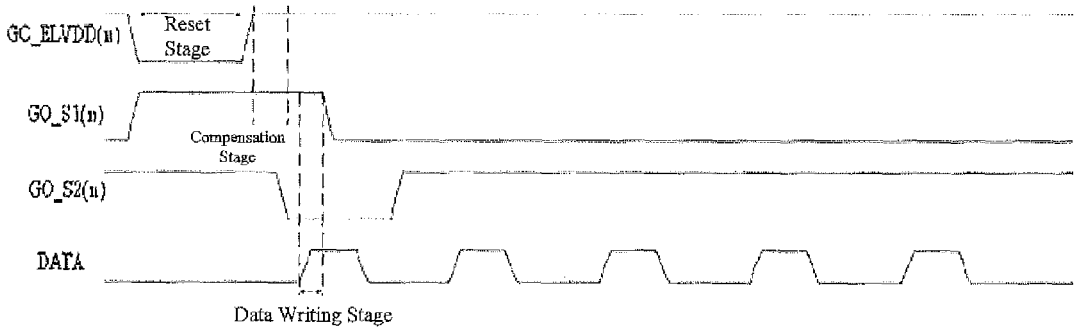
FIG. 4A is a diagram showing timing sequences of GO_ELVDD (n), GO_S1 (n) and GO_S2 (n) outputted by an N-th row pixel driving module and DATA inputted to the N-th row pixel driving module.
Figure 4B:
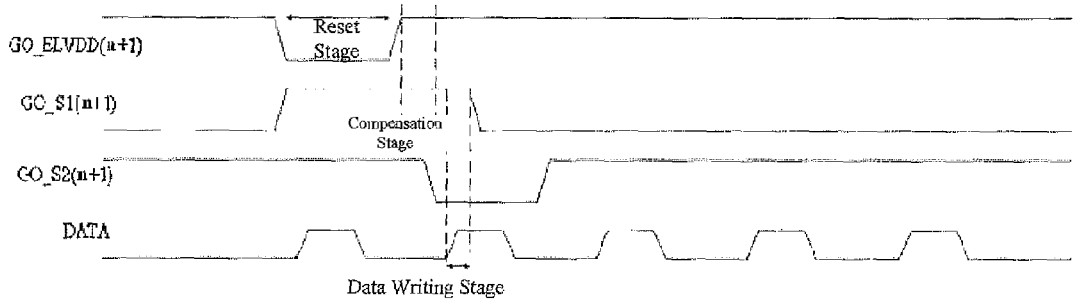
FIG. 4B is a diagram showing timing sequences of GO_ELVDD (n+1), GO_S1 (n+1) and GO_S2 (n+1) outputted by an (N+1)-th row pixel driving module and DATA inputted to the (N+1)-th row pixel driving module.

FIG. 4A is a diagram showing timing sequences of GO_ELVDD (n), GO_S1 (n) and GO_S2 (n) outputted by an N-th row pixel driving module and DATA inputted to the N-th row pixel driving module; FIG. 4B is a diagram showing timing sequences of GO_ELVDD (n+1), GO_S1 (n+1) and GO_S2 (n+1) outputted by an (N+1)-th row pixel driving module and DATA inputted to the (N+1)-th row pixel driving module.

In the above embodiment, it is designed that CLKIN3 is of one clock cycle later than CLKIN1, and CLKIN4 is of one clock cycle later than CLKIN2, an object of which is to make a waveform of GO_ELVDD (n+1) and a waveform of GO_S2 (n) be the same (as shown in FIG. 4A and FIG. 4B); therefore, GC_ELVDD (n+1) of the (N+1)-th row pixel driving module and GO_S2 (n) of the N-th row pixel driving module can use a same signal, wherein n+1 is less than or equal to a level number of gate driving circuits included in the GOA circuit.

Figure 5A:
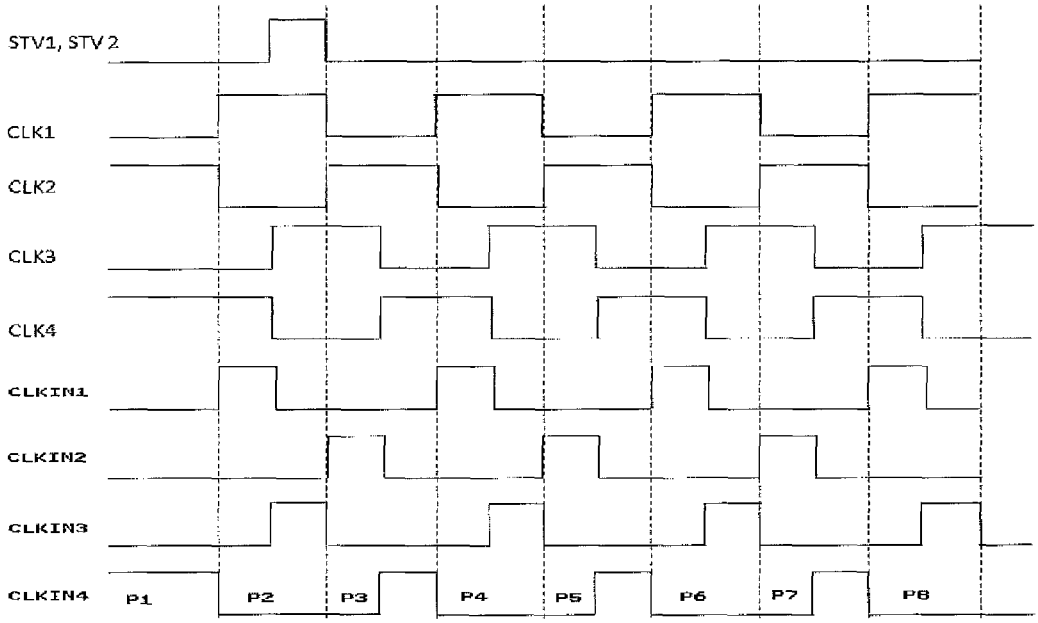
FIG. 5A is a diagram showing waveforms of STV1, STV2, CLK1, CLK2, CLK3, CLK4, CLKIN1, CLKIN2, CLKIN3 and CLKIN4 when GOA circuit is working according to an embodiment of the present disclosure.

FIG. 5A is a diagram showing waveforms of STV1, STV2, CLK1, CLK2, CLK3, CLK4, CLKIN1, CLKIN2, CLKIN3 and CLKIN4 when a GOA circuit is working according to an embodiment of the present disclosure.

Figure 5B:
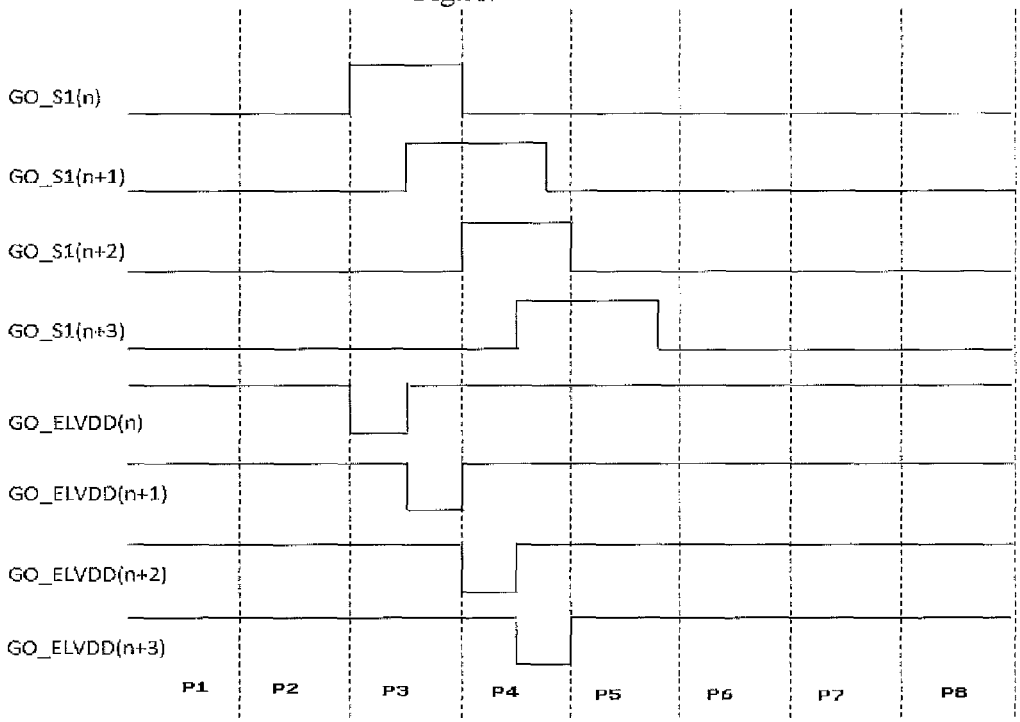
FIG. 5B is a diagram showing waveforms of GO_S1 (n), GO_S1 (n+1), GO_S1 (n+2), GO_S1 (n+3), GO_ELVDD (n), GO_ ELVDD (n+1), GO_ ELVDD (n+2) and GO_ ELVDD (n+3) outputted by a GOA circuit according to an embodiment of the present disclosure.

FIG. 5B is a diagram showing waveforms of GO_S1 (n), GO_S1 (n+1), GO_S1 (n+2), GO_S1 (n+3), GO_ELVDD (n), GO_ ELVDD (n+1), GO_ ELVDD (n+2) and GO_ ELVDD (n+3) outputted by a GOA circuit according to an embodiment of the present disclosure, where n+3 is less than or equal to the level number of gate driving circuits included in the GOA circuit.

As shown in FIGS. 5A and 5B, when the gate driving circuit as shown in FIG. 2 is working, pulling, by the second control clock switch 142, the potential of the second pulling-down node QB2 up to a high level; pulling, by the pulling-up node potential pulling-down module 102, the potential of the pulling-up node Q down to the first low level VGL1; pulling, by the first pulling-down node potential pulling-down module 12, the potential of the first pulling-down node QB1 down to the first low level VGL1; controlling, by output level pulling-up module 182, the output level end GO_ELVDD (n) to output a high level;

and controlling, by the gate scanning signal pulling-down module 172, the gate scanning signal output end GO_S1 (n) to output the second low level VGL2, in a first stage P1, during which the start signal is of a low level, the first control clock signal is of a low level, the second control clock signal is of a high level;

pulling, by the pulling-up node potential pulling-up module 101, the potential of the pulling-up node Q up to a high level; pulling, by the first pulling-down node potential pulling-down module 12, the potential of the first pulling-down node QB1 down to the first low level VGL1; pulling, by the second pulling-down node potential pulling-down module 13, the potential of the second pulling-down node QB2 down to the first low level VGL1; and turning on the input clock switch 181, in a second stage P2, during which the start signal is of a high level, the first control clock signal is of a high level, the second control clock signal is of a low level, the input clock signal is of a low level, and the signals outputted by the output level end GO_ELVDD (n) and gate scanning signal output end GO_S1 (n) remain the same;

maintaining the potential of the pulling-up node at a high level; pulling, by the first pulling-down node potential pulling-down module 12, the potential of the first pulling-down node QB1 down to the first low level VGL1; pulling, by the second pulling-down node potential pulling-down module 13, the potential of the second pulling-down node QB2 down to the first low level VGL1; turning on the input clock switch 181; outputting, by the gate scanning signal output end GO_S1 (n), a high level; outputting, by the output level pulling-down control end G_VDD, a high level; and controlling, by the output level pulling-down module 184, the output level end GO_ELVDD (n) to output the second low level VGL2, in a third stage, during which the start signal is of a low level, the first control clock signal is of a low level, the second control clock signal is of a high level, and the input clock signal is of a high level;

pulling, by the pulling-up node potential pulling-down module 102, the potential of the pulling-up node Q down to the first low level VGL1; turning on the second control clock switch 142, thereby pulling the potential of the second pulling-down node QB2 up to a high level; pulling, by the first pulling-down node potential pulling-down module 12, the potential of the first pulling-down node QB1 down to the first low level VGL1; turning off the input clock switch 181; pulling, by the gate scanning signal pulling-down module 172, the potential of the gate scanning signal down to the second low level VGL2; controlling, by the output level pulling-down control module 183, the output level pulling-down control end G_VDD to output the second low level VGL2; and controlling, by the output level pulling-up module 182, the output level end GO_ELVDD (n) to output a high level, in a fourth stage, during which the start signal is of a low level, the first control clock signal is of a high level, the second control clock signal is of a low level.

As shown in FIGS. 5A and 5B, the timing sequences of a fifth stage P5, a sixth stage Pb, a seventh stage P7, and an eighth stage P8 are as same as the first stage P1, the second stage P2, the third stage P3, and the fourth stage P4.

The above gate driving circuit may be applied in OLED display devices and low-temperature polysilicon (LTPS) display devices.

The present disclosure further provides a display device, including the above gate driving circuit. The display device may be an OLED display device or an LTPS display device.

The above is only preferred embodiments of the present disclosure, it should be noted that several improvements and modifications may be made for those of ordinary skill in the art without departing from the principle of the present disclosure, and also should be considered to fall within the protection scope of the present disclosure.

What is claimed is:

1. A gate driving circuit, connected to a row pixel circuit which comprises a row pixel driving circuit and a light emitting element connected to each other, the row pixel driving circuit comprising a driving transistor, a driving circuit and a compensation circuit, the compensation circuit being connected with a gate scanning signal, and the driving circuit being connected with a driving level; wherein the gate driving circuit comprises a row pixel control circuit, which is configured to provide the gate scanning signal to the compensation circuit and provide the driving level to the driving circuit, so as to control the compensation circuit to compensate for a threshold voltage of the driving transistor and control the driving circuit to drive the light emitting element, wherein the row pixel control circuit comprises a first control clock input end, a second control clock input end, a first control clock switch, and a second control clock switch;

wherein the first control clock switch is configured to set up a connection between the first control clock input end and a first pulling-down node, in response to the first control clock signal being of a high level;

wherein the second control clock switch is configured to set up a connection between the second control clock input end and a second pulling-down node, in response to a second control clock signal being of a high level; and wherein the first control clock signal and the second control clock signal are inverted, while an output level at the first pulling-down node and an output level at the second pulling-down node are inverted.

2. The gate driving circuit according to claim 1, wherein the row pixel control circuit further comprises:

a start signal input end;

a reset signal input end;

an input clock end;

a carry signal output end;

a cutting-off control signal output end, an output level end;

an output level pulling-down control end;

a gate scanning signal output end;

a pulling-up node potential pulling-up circuit, configured to pull a potential of a pulling-up node up to a high level, when a first control clock signal and a start signal are of a high level;

a storage capacitor, connected between the pulling-up node and the carry signal output end;

a pulling-up node potential pulling-down circuit, configured to pull the potential of the pulling-up node down to a first low level, when a potential of a first pulling-down node or a potential of a second pulling-down node is of a high level;

a first pulling-down node potential pulling-down circuit, configured to pull the potential of the first pulling-down node down to the first low level, when the potential of the pulling-up node or the potential of the second pulling-down node is of a high level;

a second pulling-down node potential pulling-down circuit, connected to the reset signal input end, configured to pull the potential of the second pulling-down node down to the first low level, when the potential of the pulling-up node or the potential of the first pulling-down node is of a high level;

a carry control circuit, configured to set up a connection between the carry signal output end and the second control clock input end, when the potential of the pulling-up node is of a high level;

a carry signal pulling-down circuit, configured to pull a potential of the carry signal down to the first low level, when the potential of the first pulling-down node or the potential of the second pulling-down node is of a high level;

a cutting-off control circuit, configured to set up a connection between the second control clock input end and the cutting-off control signal output end, when the potential of the pulling-up node is of a high level; and set up a connection between the cutting-off control signal output end and a second low Level output end, when the potential of the first pulling-down node or the potential of the second pulling-down node is of a high level;

a feedback circuit, configured to transmit a cutting-off control signal to the pulling-up node potential pulling-up circuit and the pulling-up node potential pulling-down circuit, when the carry signal is of a high level;

a gate scanning signal control circuit, configured to set up a connection between the second control clock input end and the gate scanning signal output end, when the potential of the pulling-up node is of a high level;

an input clock switch, configured to set up a connection between the input clock end and the output level pulling-down control end, when the potential of the pulling-up node is of a high level;

a gate scanning signal pulling-down circuit, configured to pull a potential of the gate scanning signal down to a second low level, when the potential of the first pulling-down node or the potential of the second pulling-down node is of a high level;

an output level pulling-down control circuit, configured to pull a potential of the output level pulling-down control end down to the second low level, when the potential of the first pulling-down node or the potential of the second pulling-down node is of a high level;

an output level pulling-up circuit, configured to pull the output level up to a high level, when an output level pulling-down control end outputs the second low level; and an output level pulling-down circuit, configured to pull the output level down to the second low level, when the output level pulling-down control end outputs a high level.

3. The gate driving circuit according to claim 2, wherein the pulling-up node potential pulling-up circuit comprises:

a first pulling-up node potential pulling-up transistor, a gate electrode and a first electrode of which are connected to the start signal input end, and a second electrode of which is connected to the feedback circuit; and a second pulling-up node potential pulling-up transistor, a gate electrode of which is connected to the first control clock input end, a first electrode of which is connected to the second electrode of the first pulling-up node potential pulling-up transistor, and a second electrode of which is connected to the pulling-up node, the pulling-up node potential pulling-down circuit comprises:

a first pulling-up node potential pulling-down transistor, a gate electrode of which is connected to the first pulling-down node, a first electrode of which is connected to the pulling-up node, and a second electrode of which is connected to the feedback circuit;

a second pulling-up node potential pulling-down transistor, a gate electrode of which is connected to the first pulling-down node, a first electrode of which is connected to the second electrode of the first pulling-up node potential pulling-down transistor, and a second electrode of which is connected with the first low level;

a third pulling-up node potential pulling-down transistor, a gate electrode of which is connected to the second pulling-down node, a first electrode of which is connected to the pulling-up node, and a second electrode of which is connected to the feedback circuit; and a fourth pulling-up node potential pulling-down transistor, a gate electrode of which is connected to the second pulling-down node, a first electrode of which is connected to the second electrode of the third pulling-up node potential pulling-down transistor, and a second electrode of which is connected with the first low level, the first pulling-down node potential pulling-down circuit comprises:

a first pulling-down transistor, a gate electrode of which is connected to the pulling-up node, a first electrode of which is connected to the first pulling-down node, and a second electrode of which is connected to the reset signal input end;

a second pulling-down transistor, a gate electrode of which is connected to the pulling-up node, a first electrode of which is connected to the second electrode of the first pulling-down transistor, and a second electrode of which is being connected with the first low level; and a third pulling-down transistor, a gate electrode of which is connected to the second pulling-down node, a first electrode of which is connected to the first pulling-down node, and a second electrode of which is connected with the first low level;

the second pulling-down node potential pulling-down circuit comprises:

a fourth pulling-down transistor, a gate electrode of which is connected to the pulling-up node, a first electrode of which is connected to the second pulling-down node, and a second electrode of which is connected to the reset signal input end;

a fifth pulling-down transistor, a gate electrode of which is connected to the pulling-up node, a first electrode of which is connected to the second electrode of the fourth pulling-down transistor, and a second electrode of which is connected with the first low level; and a sixth pulling-down transistor, a gate electrode of which is connected to the first pulling-down node, a first electrode of which is connected to the second pulling-down node, and a second electrode of which is connected with the first low level.

4. The gate driving circuit according to claim 3, wherein the carry control circuit comprises:

a carry control transistor, a gate electrode of which is connected to the pulling-up node, a first electrode of which is connected to the second control clock input end, and a second end of which is connected to the carry signal output end, the carry signal pulling-down circuit comprises:

a first carry signal pulling-down transistor, a gate electrode of which is connected to the first pulling-down node, a first electrode of which is connected to the carry signal output end, and a second electrode of which is connected with the first low level; and a second carry signal pulling-down transistor, a gate electrode of which is connected to the second pulling-down node, a first electrode of which is connected to the carry signal output end, and a second electrode of which is connected with the first low level, the cutting-off control circuit comprises:

a first cutting-off control transistor, a gate electrode of which is connected to the pulling-up node, a first electrode of which is connected to the second control clock input end, and a second electrode of which is connected to the cutting-off control signal output end;

a second cutting-off control transistor, a gate electrode of which is connected to the first pulling-down node, a first electrode of which is connected to the cutting-off control signal output end, and a second electrode of which is connected with the second low level; and a third cutting-off control transistor, a gate electrode of which is connected to the second pulling-down node, a first electrode of which is connected to the cutting-off control signal output end, and a second electrode of which is connected with the second low level, the feedback circuit comprises:

a feedback transistor, a gate electrode of which is connected to the carry signal output end, a first electrode of which is connected to the second electrode of the first pulling-up node potential pulling-up transistor, and a second electrode of which is connected to the cutting-off control signal output end.

5. The gate driving circuit according to claim 4, wherein the gate scanning signal control circuit comprises:

a gate scanning control transistor, a gate electrode of which is connected to the pulling-up node, a first electrode of which is connected with the second control clock signal, and a second electrode of which is connected to the gate scanning signal output end, the gate scanning signal pulling-down circuit comprises:

a first output pulling-down transistor, a gate electrode of which is connected to the first pulling-down node, a first electrode of which is connected to the gate scanning signal output end, and a second electrode of which is connected with the second low level; and a second output pulling-down transistor, a gate electrode of which is connected to the second pulling-down node, a first electrode of which is connected to the gate scanning signal output end, and a second electrode of which is connected with the second low level;

the output level pulling-up circuit comprises:

an output level pulling-up transistor, a gate electrode and first electrode of which are connected with a high level, and a second electrode of which is connected to the output level end, the output level pulling-down control circuit comprises:

a first pulling-down control transistor, a gate electrode of which is connected to the first pulling-down node, a first electrode of which is connected to the output level pulling-down control end, and a second electrode of which is connected with the second low level; and a second pulling-down control transistor, a gate electrode of which is connected to the second pulling-down node, a first electrode of which is connected to the output level pulling-down control end, and a second electrode of which is connected with the second low level, the output level pulling-down circuit comprises:

an output level pulling-down transistor, a gate electrode of which is connected to the output level pulling-down control end, a first electrode of which is connected to the output level end, and a second electrode of which is connected with the second low level.

6. The gate driving circuit according to claim 4, wherein the input clock switch comprises an input transistor, a gate electrode of which is connected to the pulling-up node, a first electrode of which is connected to the input clock end, and a second electrode of which is connected to output level pulling-down control end.

7. A gate driving method, applied in the gate driving circuit according to claim 2, the method comprising:

pulling, by the second control clock switch, the potential of the second pulling-down node up to a high level; pulling, by the pulling-up node potential pulling-down circuit, the potential of the pulling-up node down to the first low level; pulling, by the first pulling-down node potential pulling-down circuit, the potential of the first pulling-down node down to the first low level; controlling, by output level pulling-up circuit, the output level end to output a high level; and controlling, by the gate scanning signal pulling-down circuit, the gate scanning signal output end to output the second low level, in a first stage, during which the start signal is of a low level, the first control clock signal is of a low level, the second control clock signal is of a high level;

pulling, by the pulling-up node potential pulling-up circuit, the potential of the pulling-up node up to a high level; pulling, by the first pulling-down node potential pulling-down circuit, the potential of the first pulling-down node down to the first low level; pulling, by the second pulling-down node potential pulling-down circuit, the potential of the second pulling-down node down to the first low level; and turning on the input clock switch, in a second stage, during which the start signal is of a high level, the first control clock signal is of a high level, the second control clock signal is of a low level, an input clock signal is of a low level, and the signals outputted by the output level end and gate scanning signal output end remain the same;

maintaining the potential of the pulling-up node at a high level; pulling, by the first pulling-down node potential pulling-down circuit, the potential of the first pulling-down node down to the first low level; pulling, by the second pulling-down node potential pulling-down circuit, the potential of the second pulling-down node down to the first low level; turning on the input clock switch; outputting, by the gate scanning signal output end, a high level; outputting, by the output level pulling-down control end, a high level; and controlling, by the output level pulling-down circuit, the output level end to output the second low level, in a third stage, during which the start signal is of a low level, the first control clock signal is of a low level, the second control clock signal is of a high level, and the input clock signal is of a high level; and pulling, by the pulling-up node potential pulling-down circuit, the potential of the pulling-up node down to the first low level; turning on the second control clock switch, thereby pulling the potential of the second pulling-down node up to a high level; pulling, by the first pulling-down node potential pulling-down circuit, the potential of the first pulling-down node down to the first low level; turning off the input clock switch; pulling, by the gate scanning signal pulling-down circuit, the potential of the gate scanning signal down to the second low level; controlling, by the output level pulling-down control circuit, the output level pulling-down control end to output the second low level; and controlling, by the output level pulling-up circuit, the output level end to output a high level, in a fourth stage, during which the start signal is of a low level, the first control clock signal is of a high level, the second control clock signal is of a low level.

8. A Gate on array (GOA) circuit, comprising multi-level gate driving circuits according to claim 1; wherein each level gate driving circuit further comprises a driving control signal output end;

a start signal input end of a first level gate driving circuit and a start signal input end of a second level gate driving circuit are inputted with a start signal;

a start signal input end of an N-th level gate driving circuit is connected to a carry signal output end of an (N−2)-th level gate driving circuit, where N is an integer greater than or equal to 3 and less than or equal to M, and M is a number of levels of the gate driving circuits included in the GOA circuit;

except for a last level gate driving circuit, the driving control signal output end of each level gate driving circuit is connected to the output level end of a next level gate driving circuit;

a reset signal input end of a K-th level gate driving circuit is connected to a cutting-off control signal output end of a (K+2)-th level gate driving circuit, where K is an integer greater than or equal to 1 and less than M−1;

a first control signal input ends of odd-number-level gate driving circuits are connected with a first external control signal, and a second control signal input ends of the odd-number-level gate driving circuits are connected with a second external control signal; and a first control signal input ends of even-number-level gate driving circuits are connected with a third external control signal, and a second control signal input ends of odd-number-level gate driving circuits are connected with a fourth external control signal.

9. The GOA circuit according to claim 8, wherein the first external control signal and the second external control signal are inverted;

the third external control signal and the fourth external control signal are inverted.

10. The GOA circuit according to claim 8, wherein the third external control signal is of one clock cycle later than the first external control signal;

the fourth external control signal is of one clock cycle later than the second external control signal.

11. The GOA circuit according to claim 8, wherein an input clock signal inputted to a 2n-th level gate driving circuit and an input clock signal inputted to a (2n+2)-th level gate driving circuit are inverted;

an input clock signal inputted to a (2n−1)-th level gate driving circuit and an input clock signal inputted to a (2n+1)-th level gate driving circuit are inverted;

the input clock signal inputted to the 2n-th level gate driving circuit is of one clock cycle later than the input clock signal inputted to the (2n−1)-th level gate driving circuit;

the input clock signal inputted to the (2n+2)-th level gate driving circuit is of one clock cycle later than the input clock signal inputted to the (2n+1)-th level gate driving circuit;

where n is an integer greater than or equal to 1, and 2n+2 is less than or equal to M.

12. A display device, comprising a gate driving circuit, wherein the gate driving circuit is connected to a row pixel circuit, which comprises a row pixel driving circuit and a light emitting element connected to each other, the row pixel driving circuit comprising a driving transistor, a driving circuit and a compensation circuit, the compensation circuit being connected with a gate scanning signal and the driving circuit being connected with a driving level; wherein the gate driving circuit comprises a row pixel control circuit, which is configured to provide the gate scanning signal to the compensation circuit and provide the driving level to the driving circuit, so as to control the compensation circuit to compensate for a threshold voltage of the driving transistor and control the driving circuit to drive the light emitting element, wherein the row pixel control circuit comprises a first control clock input end, a second control clock input end, a first control clock switch, and a second control clock switch;

wherein the first control clock switch is configured to set up a connection between the first control clock input end and the first pulling-down node, in response to the first control clock signal being of a high level;

wherein the second control clock switch is configured to set up a connection between the second control clock input end and the second pulling-down node, in response to a second control clock signal being of a high level; and wherein the first control clock signal and the second control clock signal are inverted, while an output level at the first pulling-down node and an output level at the second pulling-down node are inverted.

13. The display device according to claim 12, wherein the row pixel control circuit further comprises:

a start signal input end;

a reset signal input end;

an input clock end;

a carry signal output end;

a cutting-off control signal output end;

an output level end;

an output level pulling-down control end;

a gate scanning signal output end;

a pulling-up node potential pulling-up circuit, configured to pull a potential of a pulling-up node up to a high level, when a first control clock signal and a start signal are of a high level;

a storage capacitor, connected between the pulling-up node and the carry signal output end;

a pulling-up node potential pulling-down circuit, configured to pull the potential of the pulling-up node down to a first low level, when a potential of a first pulling-down node or a potential of a second pulling-down node is of a high level;

a first pulling-down node potential pulling-down circuit, configured to pull the potential of the first pulling-down node down to the first low level, when the potential of the pulling-up node or the potential of the second pulling-down node is of a high level;

a second pulling-down node potential pulling-down circuit, connected to the reset signal input end, configured to pull the potential of the second pulling-down node down to the first low level, when the potential of the pulling-up node or the potential of the first pulling-down node is of a high level;

a carry control circuit, configured to set up a connection between the carry signal output end and the second control clock input end, when the potential of the pulling-up node is of a high level;

a carry signal pulling-down circuit, configured to pull a potential of the carry signal down to the first low level, when the potential of the first pulling-down node or the potential of the second pulling-down node is of a high level;

a cutting-off control circuit, configured to set up a connection between the second control clock input end and the cutting-off control signal output end, when the potential of the pulling-up node is of a high level; and set up a connection between the cutting-off control signal output end and a second low level output end, when the potential of the first pulling-down node or the potential of the second pulling-down node is of a high level;

a feedback circuit, configured to transmit a cutting-off control signal to the pulling-up node potential pulling-up circuit and the pulling-up node potential pulling-down circuit, when the carry signal is of a high level;

a gate scanning signal control circuit, configured to set up a connection between the second control clock input end and the gate scanning signal output end, when the potential of the pulling-up node is of a high level;

an input clock switch, configured to set up a connection between the input clock end and the output level pulling-down control end, when the potential of the pulling-up node is of a high level;

a gate scanning signal pulling-down circuit, configured to pull a potential of the gate scanning signal down to a second low level, when the potential of the first pulling-down node or the potential of the second pulling-down node is of a high level;

an output level pulling-down circuit, configured to pull a potential of the output level pulling-down control end down to the second low level, when the potential of the first pulling-down node or the potential of the second pulling-down node is of a high level;

an output level pulling-up circuit, configured to pull the output level up to a high level, when an output level pulling-down control end outputs the second low level; and an output level pulling-down circuit, configured to pull the output level down to the second low level, when the output level pulling-down control end outputs a high level.

14. The display device according to claim 13, wherein the pulling-up node potential pulling-up circuit comprises:

a first pulling-up node potential pulling-up transistor, a gate electrode and a first electrode of which are connected to the start signal input end, and a second electrode of which is connected to the feedback circuit; and a second pulling-up node potential pulling-up transistor, a gate electrode of which is connected to the first control clock input end, a first electrode of which is connected to the second electrode of the first pulling-up node potential pulling-up transistor, and a second electrode of which is connected to the pulling-up node, the pulling-up node potential pulling-down circuit comprises:

a first pulling-up node potential pulling-down transistor, a gate electrode of which is connected to the first pulling-down node, a first electrode of which is connected to the pulling-up node, and a second electrode of which is connected to the feedback circuit;

a second pulling-up node potential pulling-down transistor, a gate electrode of which is connected to the first pulling-down node, a first electrode of which is connected to the second electrode of the first pulling-up node potential pulling-down transistor, and a second electrode of which is connected with the first low level;

a third pulling-up node potential pulling-down transistor, a gate electrode of which is connected to the second pulling-down node, a first electrode of which is connected to the pulling-up node, and a second electrode of which is connected to the feedback circuit; and a fourth pulling-up node potential pulling-down transistor, a gate electrode of which is connected to the second pulling-down node, a first electrode of which is connected to the second electrode of the third pulling-up node potential pulling-down transistor, and a second electrode of which is connected with the first low level, the first pulling-down node potential pulling-down circuit comprises:

a first pulling-down transistor, a gate electrode of which is connected to the pulling-up node, a first electrode of which is connected to the first pulling-down node, and a second electrode of which is connected to the reset signal input end;

a second pulling-down transistor, a gate electrode of which is connected to the pulling-up node, a first electrode of which is connected to the second electrode of the first pulling-down transistor, and a second electrode of which is being connected with the first low level; and a third pulling-down transistor, a gate electrode of which is connected to the second pulling-down node, a first electrode of which is connected to the first pulling-down node, and a second electrode of which is connected with the first low level, the second pulling-down node potential pulling-down circuit comprises:

a fourth pulling-down transistor, a gate electrode of which is connected to the pulling-up node, a first electrode of which is connected to the second pulling-down node, and a second electrode of which is connected to the reset signal input end;

a fifth pulling-down transistor, a gate electrode of which is connected to the pulling-up node, a first electrode of which is connected to the second electrode of the fourth pulling-down transistor, and a second electrode of which is connected with the first low level; and a sixth pulling-down transistor, a gate electrode of which is connected to the first pulling-down node, a first electrode of which is connected to the second pulling-down node, and a second electrode of which is connected with the first low level.

15. The display device according to claim 14, wherein the carry control circuit comprises:

a carry control transistor, a gate electrode of which is connected to the pulling-up node, a first electrode of which is connected to the second control clock input end, and a second end of which is connected to the carry signal output end, the carry signal pulling-down circuit comprises:

a first carry signal pulling-down transistor, a gate electrode of which is connected to the first pulling-down node, a first electrode of which is connected to the carry signal output end, and a second electrode of which is connected with the first low level; and a second carry signal pulling-down transistor, a gate electrode of which is connected to the second pulling-down node, a first electrode of which is connected to the carry signal output end, and a second electrode of which is connected with the first low level, the cutting-off control circuit comprises:

a first cutting-off control transistor, a gate electrode of which is connected to the pulling-up node, a first electrode of which is connected to the second control clock input end, and a second electrode of which is connected to the cutting-off control signal output end;

a second cutting-off control transistor, a gate electrode of which is connected to the first pulling-down node, a first electrode of which is connected to the cutting-off control signal output end, and a second electrode of which is connected with the second low level; and a third cutting-off control transistor, a gate electrode of which is connected to the second pulling-down node, a first electrode of which is connected to the cutting-off control signal output end, and a second electrode of which is connected with the second low level, the feedback circuit comprises:

a feedback transistor, a gate electrode of which is connected to the carry signal output end, a first electrode of which is connected to the second electrode of the first pulling-up node potential pulling-up transistor, and a second electrode of which is connected to the cutting-off control signal output end.

16. The display device according to claim 15, wherein the gate scanning signal control circuit comprises:

a gate scanning control transistor, a gate electrode of which is connected to the pulling-up node, a first electrode of which is connected with the second control clock signal, and a second electrode of which is connected to the gate scanning signal output end, the gate scanning signal pulling-down circuit comprises:

a first output pulling-down transistor, a gate electrode of which is connected to the first pulling-down node, a first electrode of which is connected to the gate scanning signal output end, and a second electrode of which is connected with the second low level; and a second output pulling-down transistor, a gate electrode of which is connected to the second pulling-down node, a first electrode of which is connected to the gate scanning signal output end, and a second electrode of which is connected with the second low level, the output level pulling-up circuit comprises:

an output level pulling-up transistor, a gate electrode and first electrode of which are connected with a high level, and a second electrode of which is connected to the output level end, the output level pulling-down control circuit comprises:

a first pulling-down control transistor, a gate electrode of which is connected to the first pulling-down node, a first electrode of which is connected to the output level pulling-down control end, and a second electrode of which is connected with the second low level; and a second pulling-down control transistor, a gate electrode of which is connected to the second pulling-down node, a first electrode of which is connected to the output level pulling-down control end, and a second electrode of which is connected with the second low level, the output level pulling-down circuit comprises:

an output level pulling-down transistor, a gate electrode of which is connected to the output level pulling-down control end, a first electrode of which is connected to the output level end, and a second electrode of which is connected with the second low level.

17. The display device according to claim 15, wherein the input clock switch comprises an input transistor, a gate electrode of which is connected to the pulling-up node, a first electrode of which is connected to the input clock end, and a second electrode of which is connected to output level pulling-down control end.

18. The display device according to claim 12, wherein the display device is an organic light-emitting diode (OLED) display device or a low-temperature polysilicon (LTPS) display device.

* * * * *